US005463198A

United States Patent [19]

Shimaoka

[11] Patent Number: 5,463,198

[45] Date of Patent: Oct. 31, 1995

[54] SWITCHING DEVICE

[75] Inventor: Manabu Shimaoka, Furukawa, Japan

[73] Assignee: Alps Electric Co., Ltd., Tokyo, Japan

[21] Appl. No.: 257,591

[22] Filed: Jun. 9, 1994

[30] Foreign Application Priority Data

Jun. 15, 1993 [JP] Japan ..... 5-143650

[51] Int. Cl.[6] ..... H01H 13/12

[52] U.S. Cl. ..... 200/531; 200/530; 200/536; 200/252

[58] Field of Search ..... 200/530, 531, 200/536, 252, 260, 532, 520, 541, 540, 547, 549, 550, 276, 276.1

[56] References Cited

U.S. PATENT DOCUMENTS 2,454,342 11/1948 Ross ..... 200/531

4,092,503 5/1978 Raeder ..... 200/276.1

4,675,486 6/1987 Niinuma ..... 200/255

*Primary Examiner*—Henry J. Recla

*Assistant Examiner*—David J. Walczak

*Attorney, Agent, or Firm*—Guy W. Shoup; Patrick T. Bever

[57] ABSTRACT

There is provided a switching device in which the interval between a normal-close contact and a normal-open contact and the positions thereof can be arbitrarily set without any constraint of a common contact, and which can perform circuit switching at a desired timing. In the switching device, mounted on an inner bottom plane of a wafer is a common contact on which a good conductive return spring electrically connected to a movable contact for urging a slider in the direction reverse to the depressing direction is laid. A normal-close contact and a normal-open contact are arranged side by side on an inner wall of the wafer, and a resilient piece of the movable contact is in slidable contact with the inner wall.

6 Claims, 3 Drawing Sheets

SWITCHING DEVICE

BACKGROUND OF THE INVENTION

1. Field of the Invention

The present invention relates to a switching device suitable as a microswitch for position detection and so on.

2. Description of the Related Art

In a well-known type of a switching device as a microswitch for position detection, a normal-close contact and a common contact are normally electrically connected to each other, and when a slider is depressed by a predetermined stroke, a normal-open contact and the common contact are electrically connected to form another circuit.

FIG. 3 is a cross-sectional view of such kind of conventional switching device.

Referring to the figure, there is provided a case 1, a slider 2 slidably held in the case 1 to be depressed downward in the figure, a clip-shaped movable contact 3 fixed to the slider 2, a return spring 4 for urging the slider 2 in the direction reverse to the depressing direction, a normal-close contact 5, a common contact 6, and a normal-open contact 7. These fixed contacts 5, 6 and 7 are arranged at almost regular intervals to project from the case 1, and respectively connected to terminals 8, 9 and 10. In other words, a metal plate having the normal-close contact 5 and the terminal 8, a metal plate having the common contact 6 and the terminal 9 and a metal plate having the normal-open contact 7 and the terminal 10 are embedded apart from one another in the case 1 made of a synthetic resin material.

In the switching device thus constructed, when a working portion 2*a* of the slider 2 is not depressed, the normal-close contact 5 and the common contact 6 are electrically connected through the movable contact 3, and the normal-close contact 5 is held in the ON state. However, since the common contact 6 is not electrically connected to the normal-open contact 7, the normal-open contact 7 is held in the OFF state. In other words, since the slider 2 of this switching device is normally pushed up to the uppermost stroke position by the return spring 4, when it is not depressed, a circuit in which the terminals 8 and 9 are connected and the terminals 9 and 10 are not connected is formed. On the other hand, when the working portion 2a of the slider 2 is depressed by a predetermined stroke, the common contact 6 and the normal-open contact 7 are electrically connected through the movable contact 3 and the normal-open contact 7 is switched from the OFF state to the ON state after the normal-close contact 5 and the common contact 6 are disconnected, thereby selecting another circuit in which the terminals 8 and 9 are not electrically connected and the terminals 9 and 10 are electrically connected. Furthermore, when the depressing force exerted on the slider 2 is released in this state, since the slider 2 is pushed up to the uppermost stroke position by the resilience of the return spring 4, the normal-close contact 5 returns to the ON state, and the normal-open contact 7 returns to the OFF state.

Therefore, if an unillustrated object to be detected is set to depress the slider 2 when moved to a predetermined position, it can be detected that the object is placed at the predetermined position, in response to the change of a signal in the circuit switching.

In such a microswitch for position detection, if the normal-close contact 5 and the normal-open contact 7 are promptly switched from ON to OFF and OFF to ON, respectively, by depressing the slider 2, in other words, if the OFF area of the normal-close contact 5 and the ON area of the normal-open contact 7 are sufficiently allocated with respect to the total stroke of the-slider 2, the timing of detection is speeded up, thereby increasing convenience. However, in the above conventional switching device, since the common contact 6 is placed between the normal-close contact 5 and the normal-open contact 7 along the depressing direction of the slider 2, the circuit switching can be performed only when the slider 2 is firmly depressed. Therefore, it is difficult to speed up the timing of detection. In other words, since the switching device having the contact structure shown in FIG. 3 cannot perform circuit switching at a desired timing according to the usage thereof, there is little latitude in designing the device, and it is also difficult to improve the response of the device as a microswitch for position detection.

SUMMARY OF THE INVENTION

In view of the above-mentioned problems with the prior art, it is an object of the present invention to provide a switching device capable of performing circuit switching at a desired timing.

In order to achieve the above object, there is provided a switching device in which a case including a normal-close contact, a normal-open contact and a common contact arranged in positions apart from one another slidably holds a slider having a movable contact, the normal-close contact and the common contact are held in electrical connection through the movable contact when the slider is not depressed, the normal-open contact and the common contact are electrically connected through the movable contact to perform circuit switching when the slider is depressed by a predetermined stroke, wherein the common contact is mounted on an inner bottom plane of the case almost perpendicular to the depressing direction of the slider, a good conductive return spring electrically connected to the movable contact for urging the slider in the direction reverse to the depressing direction is mounted on the common contact, and the normal-close contact and the normal-open contact are placed side by side on an inner wall of the case standing relative to the inner bottom plane so as to bring the movable contact in slidable contact with the inner wall.

As described above, if the common contact and the movable contact are always electrically connected to each other through the good conductive return spring laid on the common contact, since circuit switching can be performed by bringing the movable contact in contact With and separating from the normal-close contact and the normal-open contact arranged side by side on the inner wall of the case on which the movable contact slides. Furthermore, since the interval between the normal-close contact and the normal-open contact and the mount positions thereof can be arbitrarily set without any constraint of the common contact, it is possible to perform circuit switching at a desired timing according to the usage of the device.

DESCRIPTION OF THE PREFERRED EMBODIMENT

Figure 1:
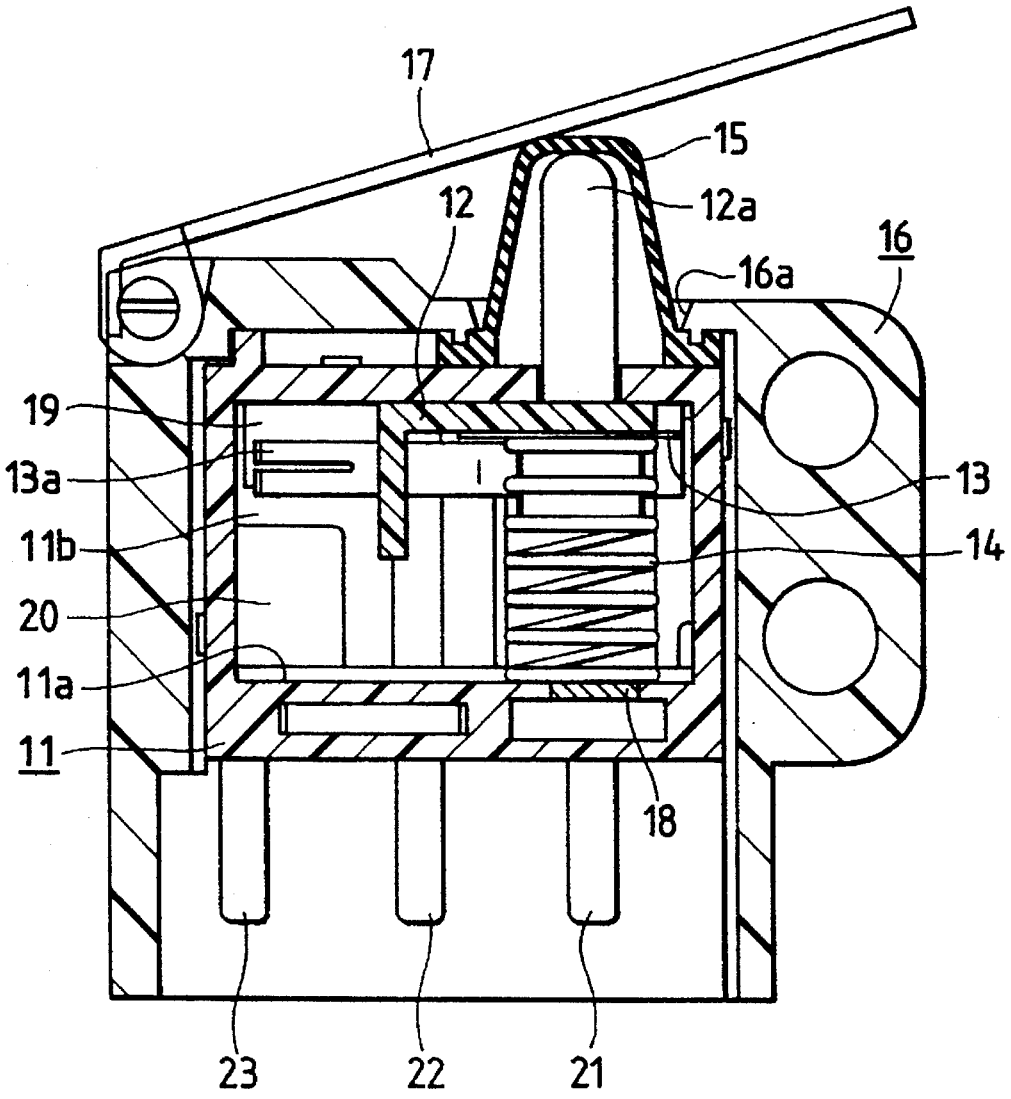
FIG. 1 is a cross-sectional view of a switching device for position detection according to an embodiment of the present invention.

An embodiment of the present invention will now be described with reference to FIGS. 1 and 2. FIG. 1 is a cross-sectional view of a switching device for position detection according to the embodiment, and FIG. 2 is an exploded perspective view of the switching device.

Figure 2:
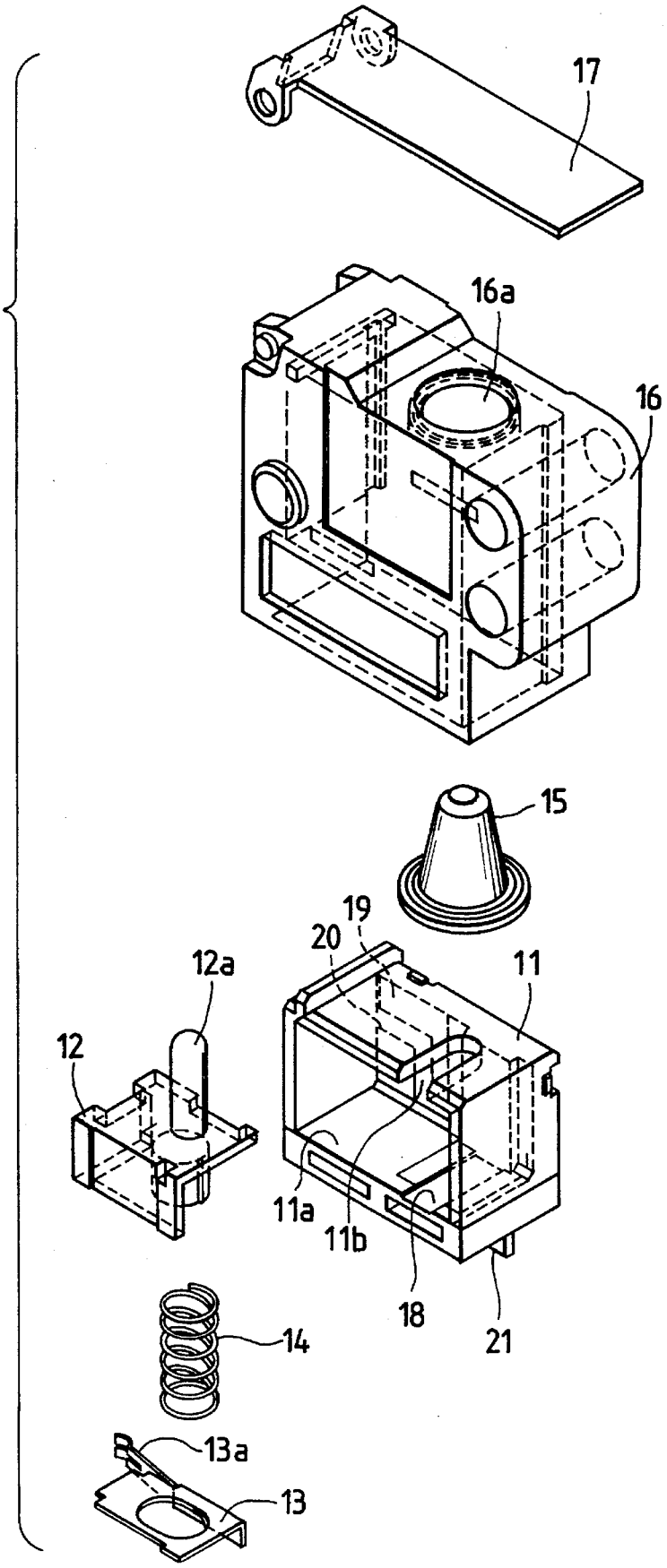
FIG. 2 is an exploded perspective view of the switching device shown in FIG. 1.
Figure 3:
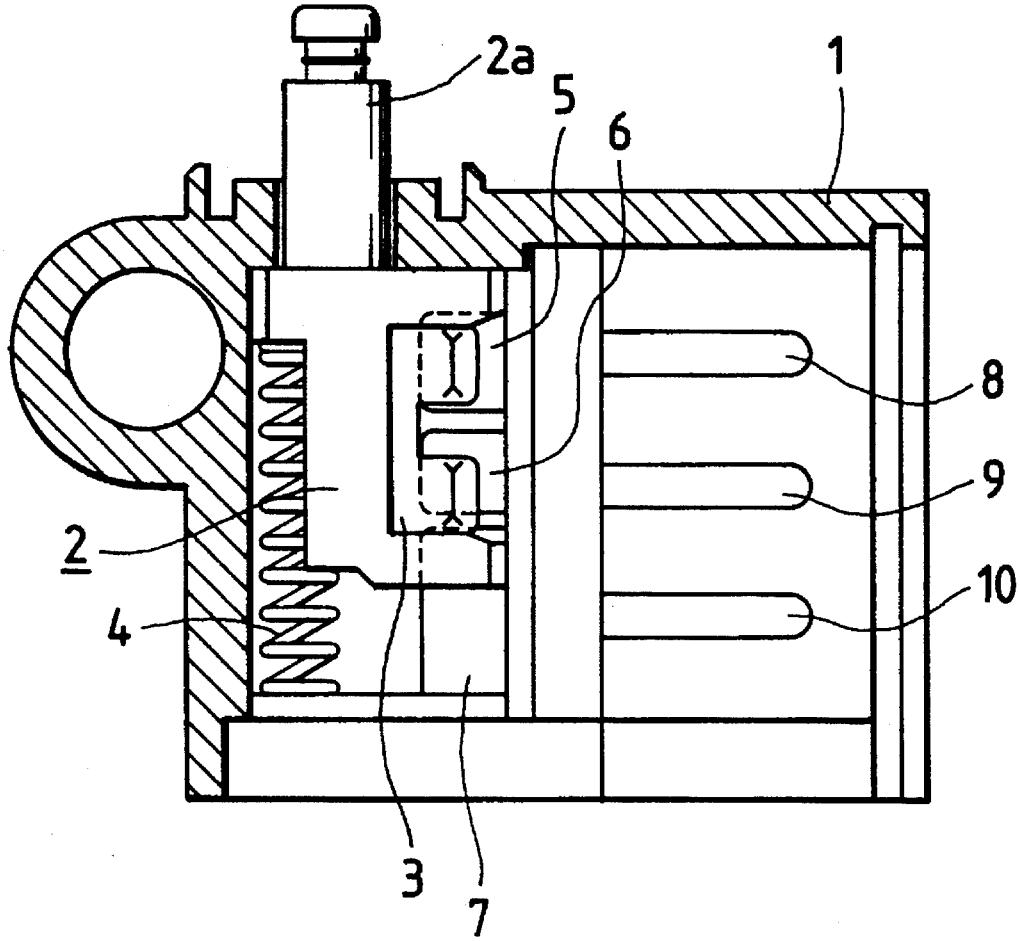
FIG. 3 PRIOR ART
FIG. 3 is a cross-sectional view of the related art.

The switching device shown in FIGS. 1 and 2 is generally comprises a wafer 11 doubling as a lower case, a slider 12 slidably held by the wafer 11 to be depressed downward in FIG. 1, a movable contact 13 having a resilient piece 13*a* and attached to the slider 12, a good conductive return spring 14 retained by the slider 12 in pressed contact with the movable contact 13 at an end thereof and laid on an inner bottom plane 11*a* of the wafer 11 at the end thereof, a resilient cap 15 laid on the wafer 11 for covering a working portion 12*a* of the slider 12, an upper case 16 for housing the wafer 11 therein and projecting the cap 15 outward from an opening 16*a* thereof, and an actuator 17 pivotally supported by the upper case 16 and in contact with the cap 15. The wafer 11 is provided with a common contact 18 exposed from the inner bottom plane 11*a* thereof, a normal-close contact 19 and a normal-open contact 20 exposed from an inner wall 11*b* standing relative to the inner bottom plane 11*a*, a terminal 21 extending from the common contact 18, a terminal 22 extending from the normal-close contact 19, and a terminal 23 extending from the normal-open contact 20. In other words, the wafer 11 is constructed by a metal plate having the common contact 18 and the terminal 21, a metal plate having the normal-close contact 19 and the terminal 22 and a metal plate having the normal-open contact 20 and the terminal 23, which are embedded in positions apart from one another therein. Since a bottom end portion in the figure of the coiled return spring 14 is in resilient contact with the common contact 18, the movable contact 13 and the common contact 18 are always electrically connected through the return spring 14 for urging the slider 12 in the direction reverse to the depressing direction. Furthermore, since the movable contact 13 makes a leading end of the resilient piece 13*a* in slidable contact with the inner wall 11*b* of the wafer 11, when the slider 12 is moved in the upward and downward directions in the figure relative to the wafer 11, the resilient piece 13*a* slides on the inner wall 11*b* to separate from and come into contact with the normal-close contact 19 and the normal-open contact 20.

In the switch thus constructed, when the actuator 17 is not pressed by an unillustrated object to be detected, and the working portion 12*a* of the slider 12 is not depressed, the normal-close contact 19 and the common contact 18 are electrically connected through the movable contact 13 and the return spring 14 as shown in FIG. 1, and the normal-close contact 19 is held in the ON state. However, since the normal-open contact 20 and the common contact 18 are not electrically connected, the normal-open contact 20 is held in the OFF state. In other words, the slider 12 which is not depressed is pushed up by the return spring 14 to the uppermost stroke position. At this time, there is formed a circuit in which the terminals 21 and 22 are electrically connected and the terminals 22 and 23 are not electrically connected.

Since the actuator 17 rotates clockwise in FIG. 1 when depressed by the object to be detected, and presses the slider 12 in through the cap 15 for water tightness downward, the movable contact 13 is disconnected from the normal-close contact 19 and the electrical connection between the normal-close contact 19 and the common contact 18 is released at the time when the working portion 12*a* of the slider 12 is depressed by a predetermined stroke. Furthermore, the movable contact 13 is brought into contact with the normal-open contact 20, and the normal-open contact 20 and the common contact 18 are electrically connected through the movable contact 13 and the return spring 14. In other words, since the normal-open contact 20 is switched from OFF to ON just after the normal-close contact 19 is switched from ON to OFF, another circuit in which the terminals 21 and 22 are not electrically connected and the terminals 21 and 23 are electrically connected is selected.

When the object to be detected which has pressed the actuator 17 is taken out and the depressing-force exerted on the slider 12 is removed after the normal-open contact 20 is thus switched to the ON state, since the slider 12 is pushed up to the uppermost stroke position by the resilience of the return spring 14, the actuator 17 is pushed up by the working portion 12*a* and returned to the initial position, the normal-close contact 19 returns to the ON state, and the normal-open contact 20 returns to the OFF state.

Thus, in the above-mentioned embodiment, since the common contact 18 exposed from the inner wall 11*a* of the wafer 11 is always electrically connected to the movable contact 13 through the good conductive return spring 14, the normal-close contact 19 and the normal-open contact 20 are arranged side by side on the inner wall 11*b* of the wafer 11 almost perpendicular to the inner bottom plane 11*a* and functioning as a slide plane of the resilient piece 13*a* of the movable contact 13, and circuit switching can be performed by bringing the resilient piece 13*a* into contact with and separating from these contacts 19 and 20. Therefore, as illustrated, it is possible to reduce the size of the operation stroke of the slider 12, required to switch the normal-open contact 20 from OFF to ON, by arranging the contacts 19 and 20 on the inner wall 11*b* so that the slide distance of the resilient piece 13*a* on the normal-open contact 20 is longer than that on the normal-close contact 19, and to achieve a microswitch for position detection which can detect quickly and is excellent in response.

Furthermore, since such contact structure makes it possible to arbitrarily set the interval between the normal-close contact 19 and the normal-open contact 20 and the positions thereof without any constraint of the common contact 18, the off timing of the normal-close contact 19 and the on timing of the normal-open contact 20 can be arbitrarily set, thereby performing circuit switching at a desired timing according to the usage.

Still furthermore, though the wafer 11 is used in the above embodiment as a case including the common contact 18, the normal-close contact 19, the normal-open contact 20 and the terminals 21, 22 and 23, since these contacts 18 to 20 and the terminals 21 to 23 can be easily formed by cutting the same metal hoop materials out in desired shapes and inserting the cut materials into a mold of the wafer 11, it is possible to enhance mass productivity and lower the production cost.

As described above, since the interval between the normal-close contact and the normal-open contact and the positions thereof can be arbitrarily set without any constraint of the common contact in the switching device according to the present invention, it is remarkably advantageous in performing circuit switching at a desired timing according to the usage. Therefore,the latitude in designing the device is enlarged. For example, a contact structure in which the normal-open contact can be promptly switched from OFF to ON makes it possible to obtain a microswitch for position detection which can quickly detect and is excellent in response.

What is claimed is:

1. A switching device comprising:

a case including a lower wall, a side wall connected to the lower wall, and an upper wall connected to the side wall, the upper wall defining an opening;

a first fixed contact embedded in an inner surface of the lower wall, the first fixed contact being electrically connected to a first lead extending from the case;

a second fixed contact embedded in an inner surface of the side wall and having a contact surface coplanar therewith, the second fixed contact being electrically connected to a second lead extending from the case;

a third fixed contact embedded in the inner surface of the side wall and having a contact surface coplanar therewith such that the third fixed contact is located between the lower wall and the second fixed contact, the third fixed contact being electrically connected to a third lead extending from the case;

a slider movably mounted in the case, the slider including a projection extending through the opening defined by the upper wall;

a movable contact fixed to the slider, the moveable contact including an arm disposed to contact the second fixed contact when the slider is in a first vertical position relative to the upper wall, and to contact the third fixed contact when the slider is in a second vertical position relative to the upper wall;

a conductive spring located between the lower wall and the slider for biasing the slider away from the lower wall, the spring having a first end electrically connected to the moveable contact and a second end electrically connected to the first fixed contact.

2. A switching device according to claim 1 wherein the arm of the moveable contact includes a fork-shaped free end.

3. A switching device according to claim 1, wherein the first, second and third fixed contacts are formed from flat metal plate and are molded integrally with the case.

4. A switching device according to claim 1, wherein the movable contact is formed from flat metal plate.

5. A switching device according to claim 1 wherein the case is an inner case, and the switching device further comprises:

an outer case including an upper wall defining a second opening, the inner case being received within the outer case such that the projection of the slider extends through the opening of the upper wall of the inner case, and through the second opening of the upper wall of the outer case;

a resilient cap having a base located between the upper wall of the inner case and the upper wall of the outer case, the resilient cap protruding above the upper wall of the outer case through the second opening such that the projection of the slider is positioned within the cap.

6. A switching device according to claim 5 further comprising:

an elongated actuator having a first end pivotally connected to the upper wall of the outer case, and a body extending from the first end and contacting the resilient cap.

* * * * *